United States Patent [19]

Betancourt

[11] 4,169,335

[45] Oct. 2, 1979

[54] MUSICAL AMUSEMENT DEVICE

[76] Inventor: Manuel Betancourt, 424 Central Ave., Apopka, Fla. 32704

[21] Appl. No.: 812,986

[22] Filed: Jul. 5, 1977

[51] Int. Cl.[2] ..... A63H 3/33

[52] U.S. Cl. ..... 46/144; 46/232

[58] Field of Search ..... 46/1 C, 144, 232; 84/464

[56] References Cited

U.S. PATENT DOCUMENTS

| | | | |
|---|---|---|---|
| 1,763,788 | 6/1930 | Jobe, Sr. | 46/232 |
| 2,254,091 | 8/1941 | Rossi | 46/144 |
| 2,307,296 | 1/1943 | Peyton | 46/144 |
| 2,466,881 | 4/1949 | Eastman | 46/144 |
| 3,018,683 | 1/1962 | Way | 84/464 |

*Primary Examiner*—Louis G. Mancene
*Assistant Examiner*—Robert F. Cutting
*Attorney, Agent, or Firm*—Duckworth, Hobby, Allen & Pettis

[57] ABSTRACT

A musical amusement device of the type designed to display miniature figures generally representing one or more humans playing musical instruments wherein one or more of the figures, either the human characters or instruments, are mechanically interconnected to one of a plurality of speakers. Each one of a possible plurality of speakers are electrically interconnected to a frequency selector in the form of filter and control circuitry which in turn is electrically connected to a sound source such as a stereo amplifier, etc. The circuitry is designed to allow only sound of a predetermined frequency range to be transmitted to the speaker which in turn causes coincident movement of the individual figures due to a mechanical, movable interconnection between the speakers and the figures themselves. The interconnection is vibration-responsive to the extent of transmitting the vibration from the speaker into related mechanical movement which in turn allows the figures to be depicted as moving in accordance with a particular sound of the instrument being played by the human characters or replicas of musical instruments which are defined by the configuration of the individual figures.

9 Claims, 3 Drawing Figures

MUSICAL AMUSEMENT DEVICE

BACKGROUND OF THE INVENTION

1. Field of the Invention

A musical amusement device constructed to display figures of predetermined configuration which are mechanically driven or moved in accordance with sound over preselected frequency ranges generated by speakers mechanically interconnected to the various figures.

2. Description of the Prior Art

Amusement devices have, of course, been in existence and utilized by mankind for hundreds of years. With the advent of modern technology, amusement devices of all types have become increasingly more sophisticated from both a mechanical and frequently electronic standpoint. Along these lines, sound oriented or musical amusement devices have received a great degree of popularity and also have increased in complexity in order to satisfy the greater requirements of modern generations. Along these lines, sound-operated musical amusement devices have been developed which are primarily directed to the displaying of various characters in the form of humans, animals, or the like. Commonly, such type devices represent movement and/or other "lifelike" characteristics being transferred to the figures or characters in order to increase the entertainment appeal and generally make the overall display more entertaining.

U.S. Pat. No. 3,292,781 to Kampe discloses the use of sound waves for operating a mimicking device. Similarly, the U.S. Pat. No. 1,763,788 to Jobe relates to the movement of figures or characters through the creation of a vibrating surface. U.S. Pat. No. 2,466,881 to Eastman discloses the use of an acoustic switch comprising a band located in cooperative engagement with a radio or like instrument to provide adequate display.

In addition to the above-noted prior art patents, the following U.S. patents all are directed to the display of toy or miniaturized characters playing instruments which are driven by mechanical means not directly associated with sound production itself.

To date, however, there is still a great desirability in the amusement device or toy industry for some type of sound-operated or driven display facility which differs significantly from the prior art devices in that one or each of a plurality of figures or characters appear to move independently of one another and, more importantly, in conjunction with a specific rhythm corresponding to the song or tune being played. Furthermore, it would, of course, be highly desirable to have each of the individual figures being represented as miniaturized players which in turn play or operate replicas of musical instruments wherein the movement of each of the players corresponds to the particular sound which theoretically would be generated by the musical instrument being played. The overall effect of independent movement corresponding to the operation of various musical instruments would produce a much more realistic and entertaining lifelike effect to an audience or operator of such an amusement device.

SUMMARY OF THE INVENTION

The present invention is directed towards a sound-operated, musical amusement device of the type serving to display a plurality of figures each having a predetermined configuration. The figures are configured to define human characters or, alternately, musical instruments which are observed visually and audibly by an audience or operator of the subject device.

An important feature of the present invention is the ability to create movement in at least one preferably a plurality of the figures representing human characters. Accordingly, a speaker is mechanically and movably interconnected with one figure so as to cause movement thereof in response to sound being transmitted to the speaker from a substantially conventional source of sound or music such as a stereo amplifier. An important feature of the present invention is the creation of movement of the figure in correspondence with sound within a predetermined frequency range. This is accomplished by feeding only sound of a predetermined frequency from the sound source through a frequency selector means in the form of a filter and control circuit capable of being preselected or tuned such that any one of a plurality of speakers picks up or has delivered thereto only sound of a predetermined frequency range. This frequency range may be preselected to correspond to the sound generated by a specific musical instrument which in turn is associated with the various figures as they are represented as playing such instruments.

More specifically, in the preferred embodiment, a plurality of figures having predetermined configurations corresponding to either human characters or musical instruments, are movably mounted on a platform means. The platform means is a part of an enlarged support frame which may be specifically configured to represent a stage or like area in miniaturized scale. A plurality of speakers are connected to the support frame. Each of the speakers are mechanically interconnected to at least one of the figures by virtue of a support means.

In turn, each of the speakers are electrically interconnected to a sound source which may be of substantially conventional design such as a stereophonic amplifier or the like. It should be noted at this point that for the purpose of clarity the sound source is mentioned both in the specification and claims. However, the source, per se, is obviously adaptable to the structure of the present invention while still being of conventional design. Accordingly, the sound source, per se, is not a part of the present invention but is described for the purpose of defining the proper environment for operational use of the subject structure.

The invention further comprises a frequency selector means which may be in the form of a filter and control circuit means disposed in electrically interconnected relation between the source of sound and each of the individual speakers which are attached to the individual figures as set forth above. The circuitry of the frequency selector means is such as to allow interconnection to the various speakers to the extent that only sound over a predetermined frequency range will be transmitted to one of the plurality of speakers. This frequency range may, of course, be preselected such that the sound generated substantially corresponds to the sound which would be created during playing of a specific musical instrument. Interconnection of a given such speaker is made with a figure generally representing a replica of a particular musical instrument designed to operate over that frequency range or a human character associated with or playing such musical instrument.

In order to accomplish the precise movement of the individual figures desired, a support means, preferably in the form of a substantially elongated shaft, is disposed in interconnecting relation between one of the speakers and a single one of the figures. Since it is obvious that vibration will occur upon sound signals being fed to the individual speakers, such vibration is transmitted to the shaft or support means which in turn is transmitted to the individual figure. Since the individual speaker only vibrates in response to sound received within a specific frequency range, the corresponding movement produced in the figure will generally correspond to the sound theoretically generated by the musical instrument being played by the human character attached to the given speaker.

A flexible attachment is disposed in interconnecting relation between the suppot means or shaft and the speaker itself. This support means or shaft connected to the flexible attachment is, therefore, vibration-responsive. Along these lines, vibration transferred to the flexible attachment is in turn transferred as mechanical movement to the shaft which in turn is connected directly to the individual figure which is moving on the platform means in plain view of the audience or operator of the device.

Other structural features of the present invention further comprise the interconnection of various lights also mounted on the platform such that the light intensity can be directly associated with the sound production and, accordingly, can be "sound-operated" in a similar manner as described with reference to the individually configured figures.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
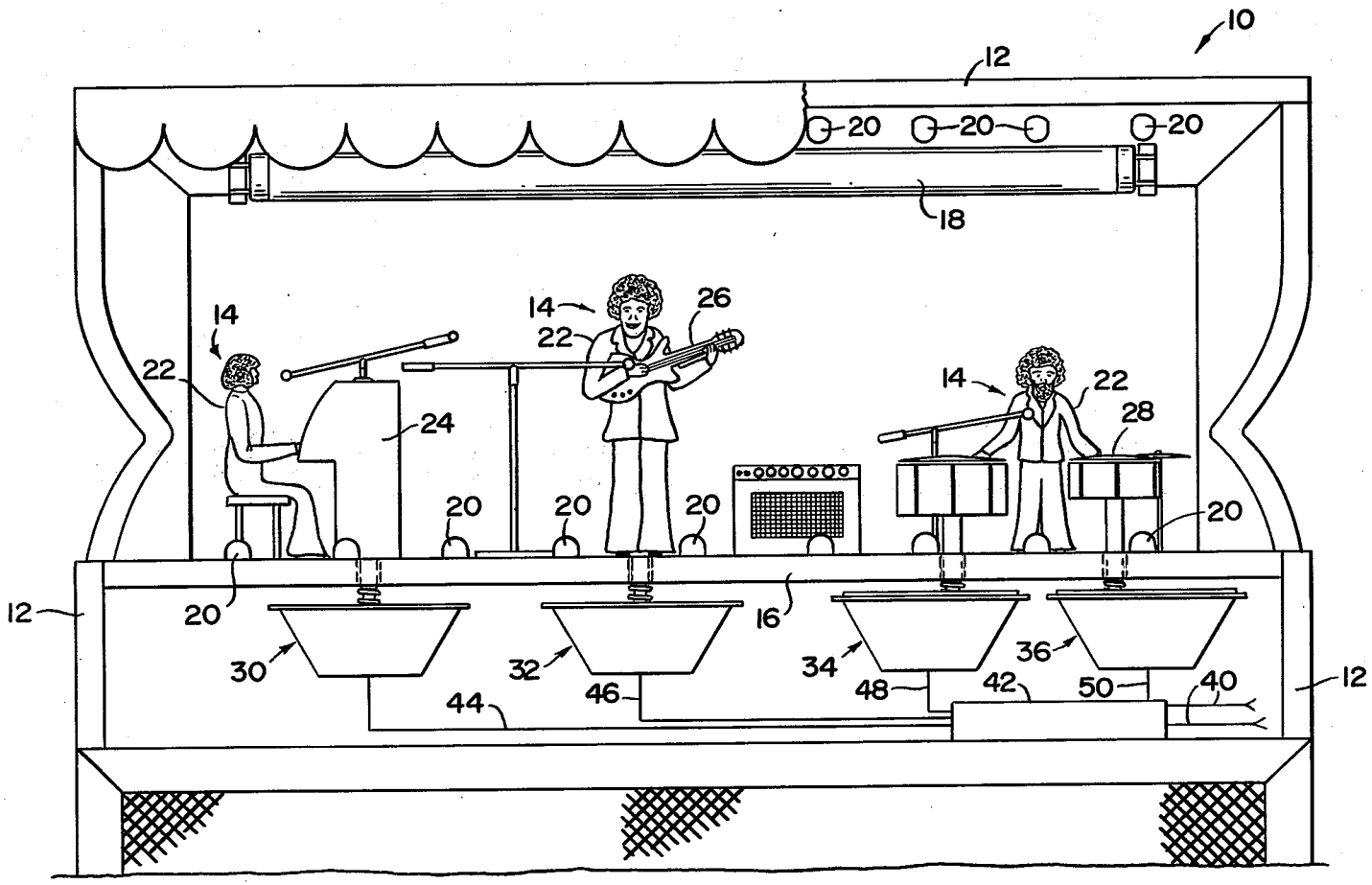
FIG. 1 is a front view, in partial cutaway, showing the various figures disposed in interconnecting relation to a plurality of speakers wherein the speakers are interconnected to applicable frequency selector means to control transmission of sound signals to each of the individual speakers.

As shown in FIG. 1, the amusement device is generally represented as 10 and includes a support frame 12 in the form of a housing or the like which may have a plurality of various configurations so as to house the individual figures 14 therein. As represented, the figures are movably mounted on a platform means 16 in a manner which will be described in detail hereinafter. Various lighting means 18 and 20 are provided at predetermined, strategic locations to emphasize the aesthetic and display features of the amusement device. As will be described in greater detail hereinafter, each of the lighting fixtures or source 18 and 20 may be "sound-operated" wherein their intensity or on/off activation may occur in response to sound frequency or sound level to provide a "strobe" effect thereby adding to the visual display of the subject device.

With regard to figures 14, each of the figures comprises a predetermined configuration which is generally defined as a human character 22 or a replica of a musical instrument 24, 26 and 28.

Again with reference to FIG. 1, a plurality of speakers 30, 32, 34 and 36 each of which are mounted on the support frame 10 and each of which are disposed in separate, mechanical interconnection to one of the figures 22 and/or 24, 26 or 28. Such mechanical interconnection occurs through the provision of a support means (see FIGS. 2 and 3) generally indicated as 38.

Each of the individual speakers 30-36 are electrically interconnected to a sound source (not shown) which may be in the form of a conventional source such as a stereophonic amplifier or the like having incoming lines 40 connected thereto.

The present invention further includes the provision of a frequency selector means schematically illustrated as reference numeral 42 and primarily comprising a filter and control circuit means serving to electrically interconnect one or each of the plurality of speakers to the sound source by means of lines 40 and individual speaker lines 44, 46, 48 and 50.

The circuitry of the filter and control circuit means is such as to allow preselected transmission of sounds within predetermined frequency ranges to each of the individual speakers 30, 32, 34 and 36. The individual frequency ranges are selected to correspond to the sound range of the replica of the musical instrument 24, 26 and 28 to which each of the individual speakers are connected. Accordingly, individual speaker 30 is preset relative to the circuitry means of the frequency selector means 42 so as to receive sounds within the piano range which, of course, corresponds to the configuration of the figure 24 as representing a replica of a piano. Upon receiving the sound within the predetermined frequency range, the speaker 30 will, of course, be caused to vibrate. This vibration will be transmitted, through the support means 38, into mechanical movement which in turn will be transmitted to the figure 22 through its interconnection either to figure 22 or the instrument figure 24. Movement therefore of the figure 22 will correspond to the "piano" portion of the sound or song, tune, etc., being played over the entire speaker facility which is heard by the audience or operator of the device. Similarly, each of the speakers 32, 34 and 36 will pick up sound signals within the predetermined frequency range corresponding to the musical instrument 26 and 28 associated with each of the individual human figures 22 as shown. The overall effect will thereby be independent movement of each of the figures in a different "rhythm" or "beat" generally corresponding to the sound generated by the instruments with which the individual human characters are associated.

Figure 2:
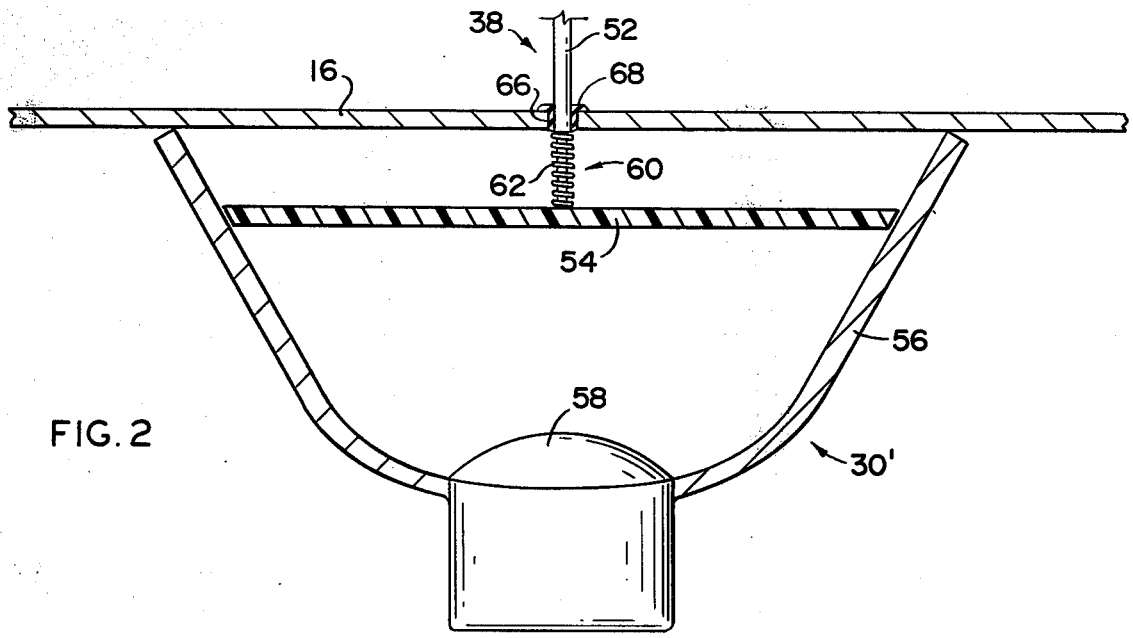
FIG. 2 is a sectional view of one embodiment of the support means being attached to the individual speakers.
Figure 3:
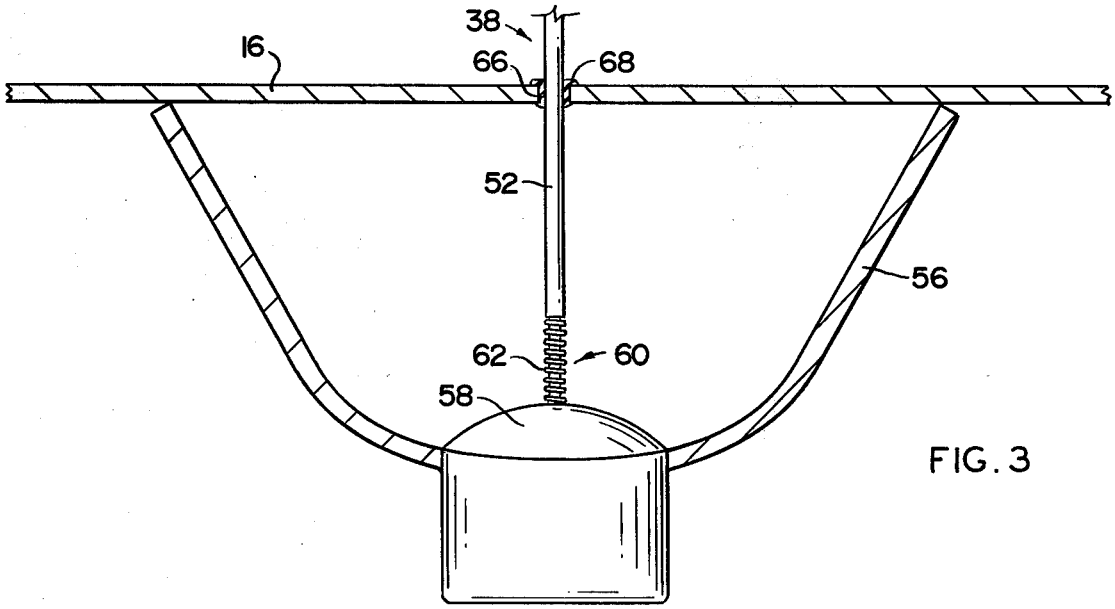
FIG. 3 is another embodiment of the support means being attached to one of the individual speakers to produce the desired movement of the individual figures.

Turning to FIGS. 2 and 3, the support means 38, in one embodiment of the present invention (FIG. 2), includes an elongated shaft 52 having its free end (not shown) directly attached to the individual figures 22 or 24, 26, and 28. The opposite end is movably connected to a base member 54 disposed on the interior of the speaker 30'. With reference to the speaker itself, each of the speakers will comprise a housing or cone portion 56 and a base portion 58 wherein the housing or cone portion 56 defines a substantially hollow interior. The end of shaft 52 associated with base element 54 is mounted generally on the interior of the housing 56 and is disposed to extend upwardly through but may be considered the platform means 12 or other means of supporting the figures as represented in FIG. 1.

A flexible attachment generally indicated as 60 may be provided in the form of a spring element 62 and disposed in interconnecting relation between the base element 54 and the remainder of the shaft 52. The provision of spring element 62 allows a movable interconnection between the base element 54 and the shaft 52. Accordingly, the disposition of the base element is such as to pick up vibration from the speaker housing during transmission of sound signals thereto. This vibration, due to the movable, flexible attachment 60, is transmitted into mechanical movement of shaft 52. The interconnection between shaft 52 and any of the individual figures 22, 24, 26 and/or 28 causes their movement in direct correspondence with the vibrations received by the speaker. Accordingly, it is readily seen that if the vibrations received are caused only by sound within a predetermined frequency range, the individual figures will be moved in accordance with the occurrence of the sound from the original soundtrack corresponding to a predetermined musical instrument (frequency range).

With reference to FIG. 3, shaft 52 is disposed on the interior of housing 56 and in direct engagement with the speaker base 58. Again, the flexible attachment 60 is provided to movably interconnect shaft 52 to the speaker base 58. Operation of the support means through mechanical movement of the shaft 52 is the same as explained with reference to FIG. 2. However, due to the shaft 52 being connected directly to the base 58, a higher quality of performance usually results.

It will be noted with regard to FIGS. 2 and 3 that in each of these embodiments the shaft 52 extends upwardly through the base through the provision of an aperture means 66. Dependent upon the materials used to form the shaft 52 and/or the platform 12 certain "noise" could possibly result due to the interaction of the periphery of the apertures 66 with the outer surface of the shaft 52. In order to reduce such noise, a noise reduction means 68 is provided in interconnected relation between the area surrounding the aperture means 66 and the shaft itself. This noise reduction means may comprise a flexible washer or disc type element having a variety of configurations as shown in FIGS. 2 and 3.

It will thus be seen that the objects set forth above, among those made apparent from the preceding description, are efficiently attained, and since certain changes may be made in the above article without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A musical amusement device of the type displaying movable, sound-responsive figures, said amusement device comprising: a support frame including platform means mounted thereon, at least one figure having a predetermined configuration and movably mounted on said platform means; at least one speaker mechanically interconnected to said one figure, said one speaker electrically interconnected to frequency selector means, said frequency selector means interconnected between a sound source and said one speaker; connecting means movably interconnecting said one speaker to said one figure and comprising support means, a flexible attachment disposed in interconnecting relation between said speaker and said support means, said flexible attachment disposed in vibration-responsive relation to said speaker and in driving relation to said support means, said support means having a shaft having one end connected to said flexible attachment and movably interconnected to said one speaker through said platform means for attachment to said one figure; said one figure movable in response to vibration of said support means as sound of a predetermined frequency is transmitted to said speaker.

2. A musical amusement device as in claim 1 wherein said flexible attachment comprises a spring element disposed to movably and drivingly connect said support means to said speaker.

3. A musical amusement device as in claim 2 wherein said speaker comprises a housing and a base portion connected thereto, said support means having one end movably attached on the interior of said housing whereby vibrations received from said speaker cause mechanical movement of said support means.

4. A musical amusement device as in claim 3 wherein said connecting means further comprises a support base disposed on the interior of said housing in spaced apart relation from the base of said one speaker, said spring element attached to said base and said support means and disposed to movably connect said support means to said one speaker.

5. A musical amusement device as in claim 3 wherein said support means is disposed on the interior of said housing and includes one end movably interconnected directly to said base portion, said spring element disposed in movable interconnection between said base portion and said support means, the opposite end of said support means extending out of the interior of said housing and into connected relation to said one figure.

6. A musical amusement device as in claim 3 wherein a noise reduction means is disposed in movable interconnected relation between said shaft and said platform means and further disposed substantially adjacent the area said shaft passes through the platform means.

7. A musical amusement device as in claim 1 comprising a plurality of figures each having a predetermined configuration and movably mounted on said platform, a plurality of speakers each of which are mechanically interconnected to one of said plurality of figures, each of said speakers electrically interconnected to said frequency selector means so as to receive sound over a predetermined frequency range therefrom.

8. A musical amusement device as in claim 7 wherein said frequency selector means comprises filter and control circuit means, each of said speakers electrically interconnected to said filter and control circuit means to receive sound signals therefrom within a preselected frequency range.

9. A musical amusement device as in claim 8 wherein certain ones of said plurality of figures are configured to correspond to replicas of musical instruments, each of said speakers electrically interconnected to said filter and control circuit means, said filter selector means defind thereby serving to transmit sound within preselected frequency ranges corresponding to the frequency range of sound normally created by a particular of said replicas of musical instruments.

* * * * *